US006854728B2

(12) United States Patent
Oister et al.

(10) Patent No.: US 6,854,728 B2
(45) Date of Patent: Feb. 15, 2005

(54) TABLETOP GAME WITH LIGHTED FEATURES

(75) Inventors: Michael J. Oister, Superior, CO (US); Thomas M. Doherty, Denver, CO (US); William C. Boettcher, Denver, CO (US)

(73) Assignee: Classic Sport Companies, Inc., Broomfield, CO (US)

( * ) Notice: Subject to any disclaimer, the term of this patent is extended or adjusted under 35 U.S.C. 154(b) by 0 days.

(21) Appl. No.: 10/825,546

(22) Filed: Apr. 14, 2004

(65) Prior Publication Data

US 2004/0195762 A1 Oct. 7, 2004

Related U.S. Application Data

(60) Division of application No. 10/424,494, filed on Apr. 25, 2003, which is a continuation-in-part of application No. 10/224,051, filed on Aug. 20, 2002.

(51) Int. Cl.[7] ..... A63F 7/06

(52) U.S. Cl. ..... 273/108.1; 273/108.2

(58) Field of Search ..... 273/108.52–108.56, 273/108.1, 108.2, 108.3, 108.4, 108.5, 108, 118 R, 118 A, 119 R, 119 A, 126 R, 126 A

(56) References Cited

U.S. PATENT DOCUMENTS

| | | | |
|---|---|---|---|
| 3,871,585 | A | 3/1975 | Crossman et al. |
| 3,889,945 | A | 6/1975 | Ellis |
| 3,926,432 | A | 12/1975 | Furr et al. |
| 4,480,833 | A | 11/1984 | Barcelow et al. |
| 4,976,434 | A | 12/1990 | Wikner |
| 5,069,458 | A | 12/1991 | Washington |
| 5,667,217 | A | 9/1997 | Kelly et al. |
| 5,791,758 | A | 8/1998 | Horgan et al. |
| 5,941,778 | A | 8/1999 | Vasalech |
| 6,234,476 | B1 | 5/2001 | Yamashita et al. |
| 6,279,905 | B1 | 8/2001 | Malavazos et al. |
| 6,371,860 | B1 | 4/2002 | Anderson |
| 2001/0030392 | A1 | 10/2001 | Huang |
| 2003/0168801 | A1 | 9/2003 | Zucchi et al. |
| 2004/0067796 | A1 | 4/2004 | Murrey et al. |

FOREIGN PATENT DOCUMENTS

| | | |
|---|---|---|
| GB | 2232606 | 12/1990 |

OTHER PUBLICATIONS

U.S. Appl. No. 60/385,375, filed Jun. 3, 2002.

*Primary Examiner*—Raleigh W. Chiu
(74) *Attorney, Agent, or Firm*—Holland & Hart LLP

(57) ABSTRACT

The present invention provides a game having accentuating light emanating through or from a translucent playing surface, sidewalls, and/or representative players.

6 Claims, 4 Drawing Sheets

TABLETOP GAME WITH LIGHTED FEATURES

RELATED APPLICATIONS

This application is a divisional of U.S. patent application Ser. No. 10/424,494, filed Apr. 25, 2003, titled "TABLETOP GAME WITH LIGHTED FEATURES," which is a continuation-in-part of U.S. patent application Ser. No. 10/224.051, filed Aug. 20, 2002, titled "TABLETOP GAME WITH LIGHTED PLAYING FIELD."

FIELD OF THE INVENTION

The present invention relates to tabletop games and, more particularly, to tabletop sports games, such as foosball, baseball, basketball, bowling, hockey, or the like, having lighted fixtures.

BACKGROUND OF THE INVENTION

Many arcade style tabletop games exists. Some of the more popular arcade style tabletop games simulate soccer (or football as it is known outside of the United States) and hockey. These games typically comprise a tabletop playing field that simulates the field and players of the actual game. While the below application refers to soccer simulations, a.k.a. foosball games, one of ordinary skill in the art will recognize other tabletop games can be substituted for foosball.

A foosball table includes rows of representative athletes, suspended like pendulums from control rods that are mounted transversely above a playing field. Players slide and rotate the control rods to make the athletes kick a small ball, attempting to score a goal. The representative athletes are suspended over a playing field that represents a traditional soccer field. Often times, the traditional field is modified in the corners to provide a slope so the foosball does not get caught in the corner. Instead of slopes, some style foosball games have representative goalies (one or more) that can extend into the one or the other of the corners.

While generally enjoyable in its own right, these tabletop games frequently do not sustain the interest of players for an) length of time. Thus, it would be desirable to produce a tabletop game having additional features to increase interest in the tabletop game.

SUMMARY OF THE INVENTION

To attain the advantages and in accordance with the purpose of the invention, as embodied and broadly described herein, a tabletop game is provided having a clear, translucent or semi-translucent surface. A light source is placed under the surface.

Another feature of the present invention is a tabletop game with lighted representative players. Still another feature of the present invention is a tabletop game with lighted sidewalls.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
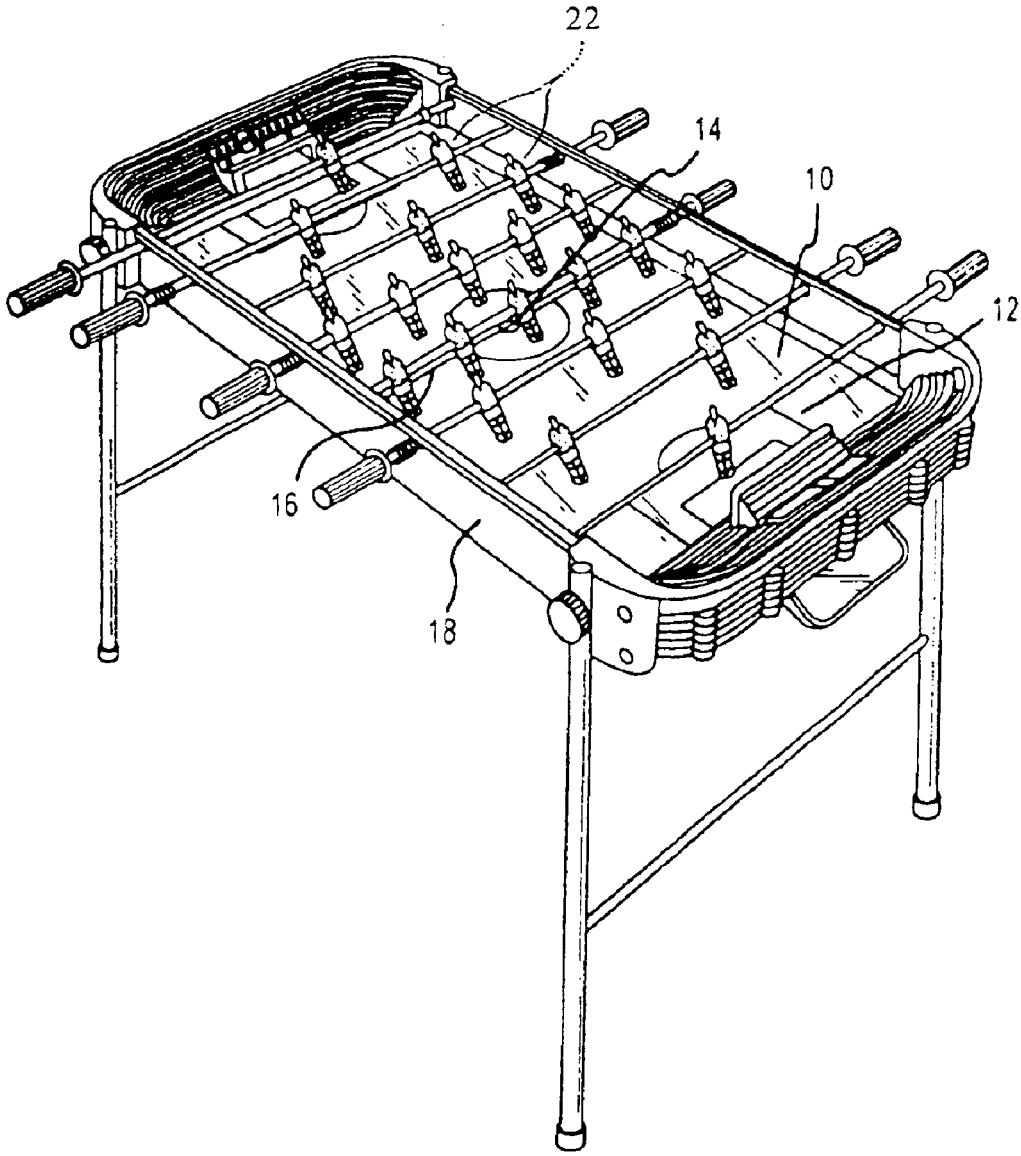
FIG. 1 shows a perspective view of a foosball game illustrative of the present invention.
Figure 2:
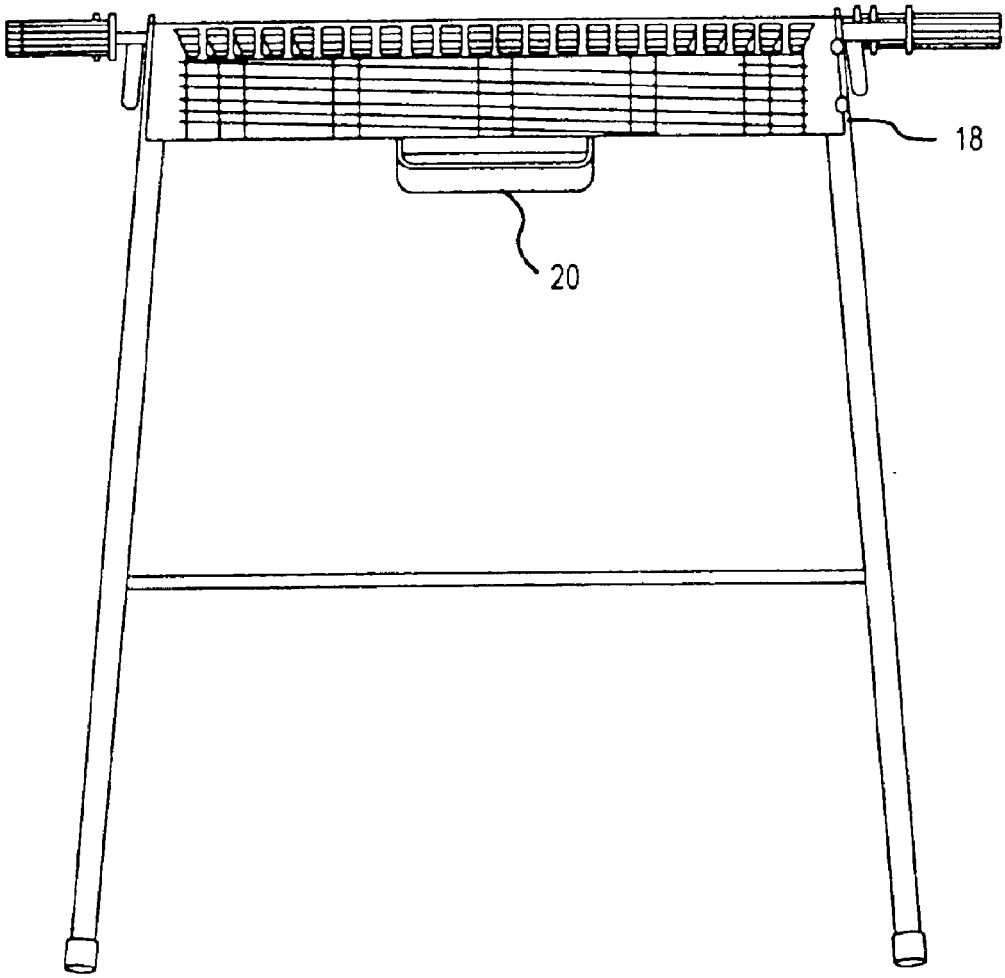
FIG. 2 shows a side plan view of the foosball game illustrative of the present invention.

The present invention will be further explained with reference to FIGS. 1 to 4. With reference to FIGS. 1 and 2, a representation of a soccer field is generally illustrated by playing field 10. Playing field 10 may include indicia of a regulation soccer field including, for example, goalie box 12, Center kickoff circle 14, center line 16, and the like. Playing field 10 is surrounded by sidewall 18. Instead of regulation markings, playing field 11 may have indicia of players, whimsical designs, or the like.

Playing field 10 is made, at least in part, of a material clear, transparent, translucent, or semi-translucent to light. For simplicity, the term translucent as used in this application, is intended to encompass anything other than opaque. For example, playing field 10 could be a clear plastic, glass, colored plastic, colored glass, a frosted glass like surface, or the like. Further, playing field 10 could have portions of the playing surface translucent (including varying degrees of translucence) or opaque to form patterns and designs in the playing surface. Still further, playing field 10 could be designed to have a lighting effect that may reflect, refract, or disburse light, such as, for example, a prism. A light source, which will be explained further below, can be placed below the playing field 10, providing a lighted surface on which foosball could be played.

Referring now to FIG. 2, a side plan view of the foosball table is provided. Residing beneath playing field 10, is at least one light source 20. As shown, light source 20 could be a single florescent light tube extending down the center of the playing surface. Of course, the tabletop game could be designed so that the light is completely or partially enclosed by the sidewalls. However, multiple rows of florescent light tubes may be used. Further, light tubes could be arranged parallel or diagonal to the long or short dimension of the playing field 10. Other types of lights, however, could also be possible, such as, incandescent lights, halogen lights, light strings (such as Christmas lights), lcds, leds, lasers, electro luminescent light sources, chemical light sources, light tubes, flexible light wires, or the like. Still further, one or more light sources may be mounted in sidewalls so lights tubes, such as florescent lights would not have to run the length of the playing field. In general, almost any arrangement of light can be provided depending on the lighting effect desired. Further, light source 20 could be a strobe light or other light that has an on and off feature, similar to a timer, or a string of blinking Christmas lights. Still further, it would be possible to have a dimmer to manually or automatically control the brightness of light source 20. Finally, a timer could be used to control an on and off pattern of the lights and the dimmer.

Figure 3:
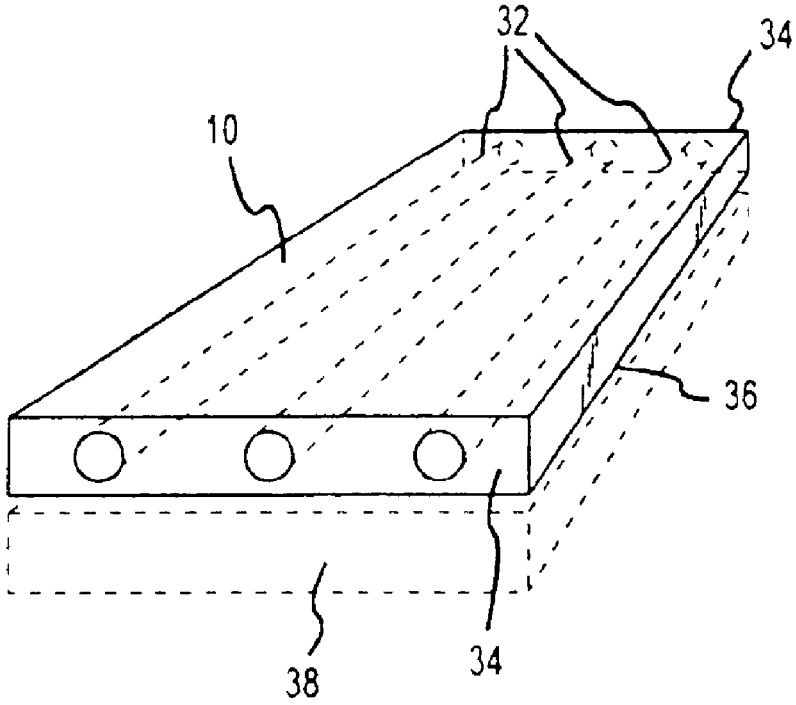
FIG. 3 is a perspective view of a playing surface associated with one potential embodiment of the present invention.

Instead of having light source 20 reside beneath the playing field 10 as shown, it would be possible to mold a glass or plastic playing surface such that one or more tubes or conduits 32 existed in the playing field 10, as shown in phantom in FIG. 3. For example, FIG. 3 shows three conduits 32 molded in playing field 10. In this case, conduits 32 are open to each end 34 of playing field 10, but conduits 11 could be open on one, both, or neither side. If ends 34 and conduits 32 are not open, light could be coupled, refracted, or reflected into conduits 32 through a solid end 34. While conduits 32 are shown generally straight and parallel the longer dimension of playing field 10, other configurations are possible. Conduits 32, for example, do not need to be identical, could be curved, could be part curved and part straight, could be diagonal, or the like. Further, conduits 32 are shown with a cylindrical geometric shape, but other shapes are possible whether irregular, random, or geometric. Further, ridges, grooves and other imperfections in the conduits may cause desirable lighting effects (such as a prism effect).

FIG. 3 shows optional reflective layer 36. Instead of reflective layer 36, a reflective surface 38 could be supplied, which is shown in phantom. Reflective layer 36 or reflective surface 38 can be any conventional light reflecting surface, such as a mirror or mirrored coating on, for example, glass. While reflective layer 36 or reflective surface 38 could be used with any light source mentioned to provided various lighting effects, it is contemplated that reflective layer 36 or reflective surface 38 would enhance the ability of light source(s) 20 residing along a sidewall to illuminate areas of playing field 10 not substantially adjacent light source(s) 20.

It is believe using reflective layer 36 or reflective surface 38 will reduce the amount of light the light source needs to provide. By, reducing the amount of light the light source needs to provide, it is hoped that the number of lights that need to be packaged will be reduced.

A light source (not shown in FIG. 3) could be placed such that light from the source shines down conduits 32. Instead of simply providing a light source, conduits 32 could be lined to enhance the light or light carrying ability. Further, emitting tubes could be placed in conduits 32 to assist in light transmission. Such light carrying tubes are described in, for example, U.S. Pat. No. 5,879,076, titled "METHOD AND APPARATUS FOR LIGHT TRANSMISSION," issued on Mar. 9, 1999. Other light tubes include electro luminescent lights as described in, for example, U.S. Pat. No. 5,485,335, titled "ELECTROLUMINESCENT LIGHT SOURCES," issued on Jan. 16, 1999, U.S. Pat. No. 5,860, 930, titled "ELECTROLUMINESCENT LIGHT SOURCE WITH A MIXTURE LAYER FILLED WITH A TRANSPARENT FILLER SUBSTANCE," issued on Feb. 9, 1999, and U.S. Pat. No. 6,400,093, titled "FLEXIBLE ELECTROLUMINESCENT LIGHT SOURCE WITH ACTIVE PROTECTION FROM MOISTURE," issued Jun. 4, 2002, incorporated by reference. Electro luminescent light sources are sometimes known as flexible light wire. Other light sources include chemical luminescent compositions, which are sometimes known as light sticks, such as U.S. Pat. No. 4,313,843, titled "SUPERIOR OXALATE ESTER CHEMICAL LIGHTING SYSTEM," issued on Feb. 2, 1982, and U.S. Pat. No. 4,678,608, titled "CHEMILUMINESCENT COMPOSITION," issued on Jul. 7, 1987. All of which are incorporated herein by reference.

Referring back to FIG. 1, residing substantially about playing surface 10 are a plurality of representative players 22. While not shown in detail, one or more players 22 could incorporate various types of lights also. For example, flexible light wire could be used to illuminate an edge of one or more players 22, LCD light sources could be used to illuminate a strike surface 22*s* on one or more players 22. It is contemplated that players 22 could have some type of electro luminescent light source or chemical luminescent light source because, for manufacturing purposes, it would be difficult to supply a power source to players 22. However, other styles of light sources can be used, such as, conventional lights, lasers, strobes, halogens, fluorescents, and the like. Power for lights could be supplied by running power through bars 24 on which players 22 reside, in this case, by batteries (not shown) contained in players 22, or the like. Other style games may have more or less options for supplying power to players 22. For example, a hockey style game typically has runners in playing surface 10 instead of bars 24 for players 22. Thus, contacts could be supplied along the runners to enable power to players 22.

Tabletop games, be they foosball games, table hockey games, football games, or baseball games, basketball games, or the like generally define playing field 10 by a sidewall 18. As mentioned above, sidewall 18 may have lights affixed to reduce other lighting requirements. Further, sidewall 18 may also be translucent, opaque, or a combination thereof to provide reflective light from light source 20 or a separate light source (not shown). Moreover, in some embodiments of the present invention, playing field 10 may be completely opaque, but sidewall 18 may be at least partially translucent to allow light to pass.

Figure 4:
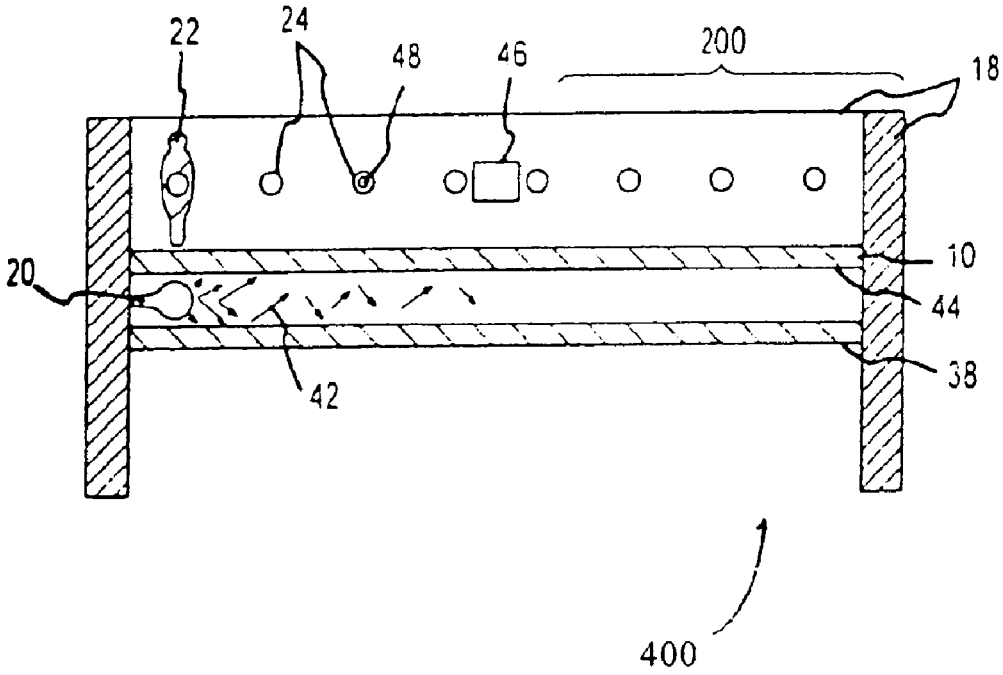
FIG. 4 is a cross sectional view of a tabletop game illustrative of the playing surface described in FIG. 3.

Referring now to FIG. 4, a tabletop game 400 is shown using the reflective surface 38. As shown by the cross sectional view, game 400 has a playing surface 10 surrounded by sidewalls 18. For convenience, one representative player 22 (the goalie) is shown on a series of cross bars 24. Under playing surface 10 is light source 20 arranged on sidewall 118. Sidewall 18 can be arranged as shown to have a continuous side, or sidewall 18 could be broken into separate parts, such as a playing field portion above playing field 10 and a support portion below playing field 10. In this case, a single light source 20 is shown between playing field 10 and a reflective surface 38, such as a mirror. Arrows 42 indicate how the single light source 20 can illuminate the entire playing field by reflecting light off of surface 38. If playing surface 10 had a laser or coating 44 of a partially reflective material, more light would be transmitted to side 200 opposite light source 20. Partially reflective means some light passes through layer 44 and some is reflected back to reflective surface 38. The amount of light actually passed by the partially reflective material is a matter of design choice. FIG. 4 also shows a ball drop 46. If, as mentioned above, lights are provided on players 22, power could be supplied to the players by wires 48 running through cross bars 24.

While the invention has been particularly shown and described with reference to particular embodiment(s) thereof, it will be understood by those skilled in the art that various other changes in the form and details may be made without departing from the spirit and scope of the invention.

We claim:

1. A tabletop game comprising:

a playing surface;

at least one representative player residing above the playing surface;

at least one player light source illuminating at least a portion of the at least one representative player; and means for supplying power to the at least one player light source, wherein the means for supplying power includes at least one battery in the at least one representative player.

2. A tabletop game comprising:

a playing surface;

at least one representative player residing above the playing surface;

at least one player light source illuminating at least a portion of the at least one representative player; and means for supplying power to the at least one player light source, wherein the means for supplying power includes at least one power feed and, wherein the at least one power feed resides in at least one cross bar arranged to hold the at least one representative player above the playing surface.

3. A tabletop game comprising:

a playing surface wherein at least one portion of the playing surface is capable of passing light;

at least one representative player residing above the playing surface;

at least one player light source illuminating at least a portion of the at least one representative player; and at least one playing surface light source arranged such that light is viewable from above the playing surface through the at least one portion of the playing surface; and, a reflective surface below the playing surface.

4. The tabletop game according to claim 3, wherein the at least one playing surface light source is arranged in the same plane as the playing surface.

5. A tabletop game comprising:

a playing surface wherein at least one portion of the playing surface is capable of passing light;

at least one representative player residing above the playing surface;

at least one player light source illuminating at least a portion of the at least one representative player; and at least one playing surface light source arranged such that light is viewable from above the playing surface through the at least one portion of the playing surface; and, a reflective coating on a bottom of the playing surface.

6. The table top game according to claim 5, wherein the at least one playing surface light source is arranged in the same plane as the playing surface.

* * * * *